US007827841B2

(12) United States Patent
Shore et al.

(10) Patent No.: US 7,827,841 B2
(45) Date of Patent: Nov. 9, 2010

(54) METHOD OF AND SYSTEM FOR PROCESSING DIFFERENT SIZED LONG PRODUCTS

(75) Inventors: T. Michael Shore, Princeton, MA (US); Matthew Palfreman, Charlton, MA (US); William X. Shen, Boylston, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 635 days.

(21) Appl. No.: 11/620,849

(22) Filed: Jan. 8, 2007

(65) Prior Publication Data

US 2007/0090223 A1 Apr. 26, 2007

Related U.S. Application Data

(60) Provisional application No. 60/791,779, filed on Apr. 13, 2006.

(51) Int. Cl.
*B21D 11/00* (2006.01)
*B21F 3/02* (2006.01)

(52) U.S. Cl. ..... 72/66; 72/140

(58) Field of Classification Search ..... 72/66, 72/135, 140, 159, 166–167; 242/361, 82
See application file for complete search history.

(56) References Cited

U.S. PATENT DOCUMENTS

| | | | | |
|---|---|---|---|---|
| 3,823,590 | A * | 7/1974 | Lang | 72/66 |
| 3,843,072 | A * | 10/1974 | Rayfield | 242/361 |
| 4,109,879 | A * | 8/1978 | Properzi | 242/361 |
| 5,307,663 | A | 5/1994 | Shore et al. | |
| 5,934,536 | A * | 8/1999 | Shore et al. | 226/177 |
| 6,179,237 | B1 * | 1/2001 | David et al. | 242/361 |
| 6,260,781 | B1 * | 7/2001 | Cooper | 242/361.4 |
| 6,584,823 | B2 * | 7/2003 | Hresc et al. | 72/129 |
| 6,769,641 | B2 | 8/2004 | Pariseau et al. | |
| 6,910,360 | B2 * | 6/2005 | Stjepan et al. | 72/140 |
| 2003/0084974 | A1 * | 5/2003 | Benedetti | 148/663 |
| 2004/0118960 | A1 * | 6/2004 | Smith et al. | 242/361 |
| 2005/0247364 | A1 * | 11/2005 | De Lucca et al. | 138/142 |

FOREIGN PATENT DOCUMENTS

| | | |
|---|---|---|
| EP | 0779115 | 6/1997 |
| EP | 0779115 A1 | 6/1997 |
| EP | 1455962 B1 | 9/2005 |
| JP | 2001038418 A | 2/2001 |
| JP | 2001213574 A | 8/2001 |
| WO | 2006111382 | 10/2006 |
| WO | WO 2006111382 A2 | 10/2006 |

* cited by examiner

*Primary Examiner*—Dana Ross
*Assistant Examiner*—Mohammad Yusuf
(74) *Attorney, Agent, or Firm*—Michael J. Wallace, Jr.

(57) ABSTRACT

A method of processing different sized long products delivered from a rolling mill, comprising forming products within a first range of sizes into helical formations of rings having a first diameter, and alternatively forming products within a second range of sizes larger than the largest product size within said first range into helical formations of rings having a second diameter larger than said first diameter. The helical formations of rings are deposited on a conveyor for transport to a reforming station where they are gathered into coils.

6 Claims, 6 Drawing Sheets

METHOD OF AND SYSTEM FOR PROCESSING DIFFERENT SIZED LONG PRODUCTS

CROSS REFERENCE TO RELATED APPLICATION

This application claims priority from provisional patent application Ser. No. 60/791,779 filed on Apr. 13, 2006.

BACKGROUND OF THE INVENTION

1. Field of the Invention

This invention relates generally to rolling mills in which laying heads form hot rolled long products into helical ring formations that are deposited on and carried by cooling conveyors to reforming chambers where the rings are gathered into coils, and is concerned in particular with maximizing the density of such coils.

2. Description of the Prior Art

The laying heads of rolling mills are conventionally employed to form hot rolled long products into rings having the same diameter for all product sizes. As herein employed, the term "long products" means round bars and rods, and "size" refers to product diameters.

By way of a non-limiting example, a laying head will produce rings having a diameter of 1075 mm. For products ranging in size from about 5 to 16 mm, rings of this diameter are deposited into and distributed within the reforming chambers to produce reasonably dense and compact coils. However, when the laying heads process larger product sizes, e.g., ranging from 17 to 26 mm, rings with the same diameter tend to resist being satisfactorily distributed in the reforming chambers. The resulting coils thus tend to lack sufficient density, with a somewhat open and random ring distribution that contributes to coil instability.

SUMMARY OF THE INVENTION

In accordance with the present invention, smaller product sizes are formed into conventionally sized rings and larger product sizes are formed into larger rings. The larger rings of the larger size products are less resistant to satisfactory distribution in the reforming chambers, which in turn makes it possible to form more compact and stable coils.

The invention will now be described in further detail with reference to the accompanying drawings, wherein:

DETAILED DESCRIPTION

Figure 1:
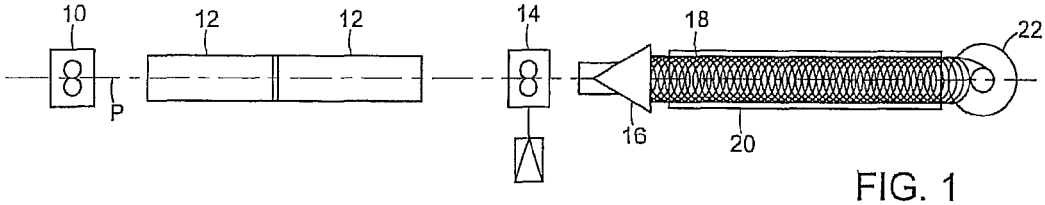
FIG. 1 (PRIOR ART)
FIG. 1 is a schematic plan view of the delivery end of a conventional rolling mill.

With reference initially to FIG. 1, the delivery end of a rolling mill is shown comprising the last roll stand 10 from which the hot rolled product exits along a delivery end path "P". The product is cooled by one or more water boxes 12 before being fed by a pinch roll unit 14 to a laying head 16. The laying head forms the product into a helical formation of rings 18 which are deposited on and carried by a cooling conveyor 20 away from the laying head to a reforming chamber 22 where they are gathered into coils.

Figure 2A:
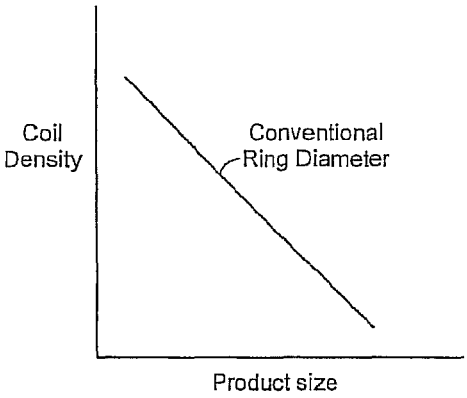
FIGS. 2A and 2B are diagrams depicting the relationship between coil density and product size for different ring diameters.

As previously noted, the conventional practice has been to form all product sizes into rings having the same diameter. As shown in FIG. 2A, it has been determined that for a given ring diameter, the density of the coils formed in the reforming chamber 22 will decrease as the product sizes increase.

Figure 2B:
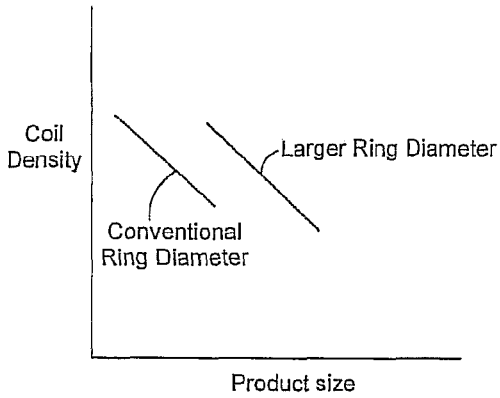

As shown in FIG. 2B, the present invention departs from this conventional practice by increasing the ring diameter for larger product sizes. Coil density for the larger product sizes is thus beneficially enhanced.

Figure 3:
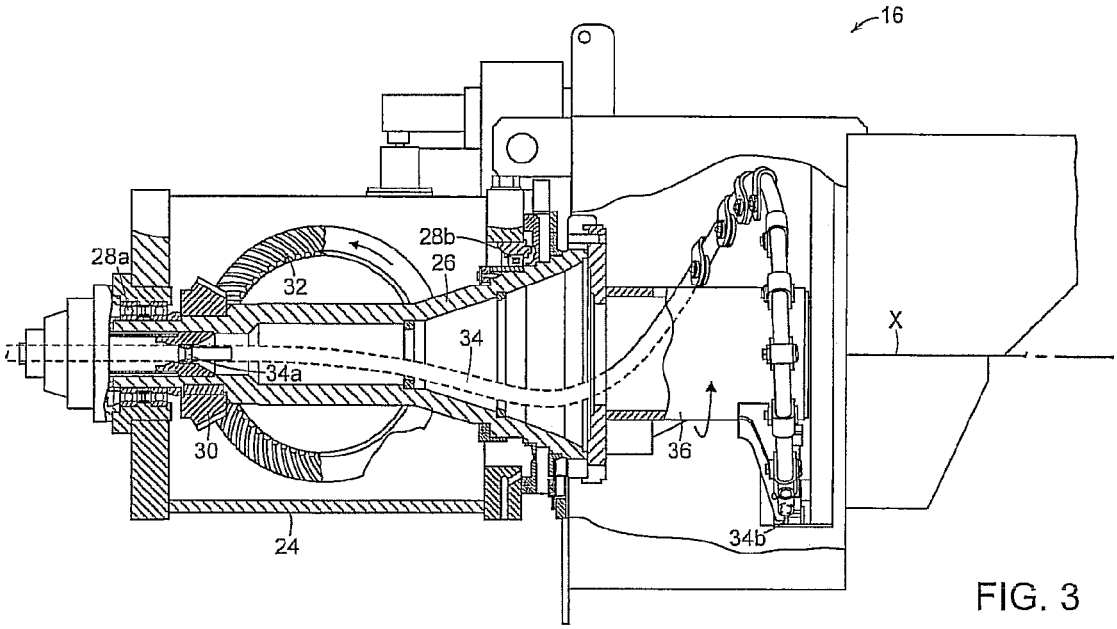
FIG. 3 is a longitudinal sectional view taken through a laying head.

With reference to FIG. 3, the laying head 16 comprises a housing 24 enclosing a quill 26 supported by bearings 28*a*, 28*b* for rotation about an axis "X". Quill 26 carries a bevel gear 30 in meshed relationship with a larger bevel gear 32, the latter being driven by conventional means (not shown). A curved laying pipe 34 is carried by a support 36 attached to the front end of the quill. The laying pipe 34 has an entry end 34*a* aligned on axis X to receive the hot rolled product, and a delivery end 34*b* spaced radially from the axis X and from which the product is delivered as the helical ring formation 18.

Figure 4A:
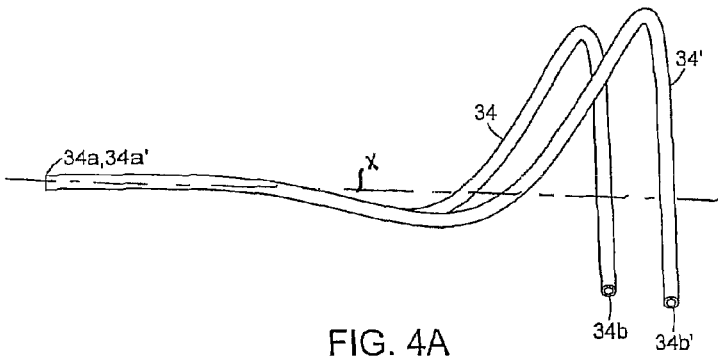
FIGS. 4A and 4 B are side and front views respectively of interchangeable laying pipes configured to form rings of different diameters.
Figure 4B:
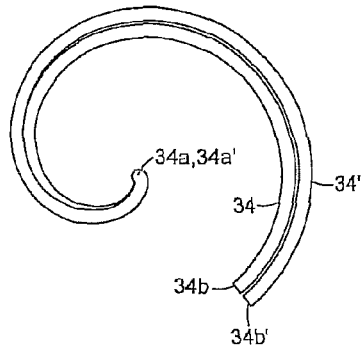

In accordance with one aspect of the present invention, the laying head 16 may be equipped with two or more interchangeable and differently configured laying pipes, two being shown at 34 and 34' in FIGS. 4A and 4B. Both laying pipes have entry ends 34*a*, 34*a*' configured for alignment on axis X. However, the delivery end of pipe 34*b*' is spaced radially from axis X by a radius that is larger than the radius of the delivery end 34*b* of pipe 34. When processing smaller product sizes, pipe 34 and its appropriately configured support will be installed in the laying head 16. For larger product sizes, pipe 34 will be replaced by pipe 34', again with its respective appropriately configured support.

Figure 5A:
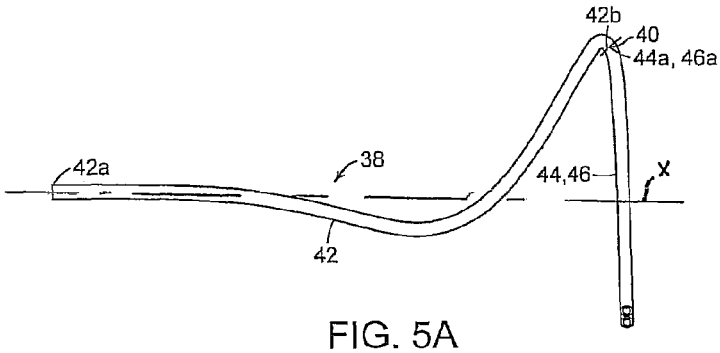
FIGS. 5A and 5B are side and front views respectively of a laying pipe with interchangeable delivery sections configured to form rings of different diameters.
Figure 5B:
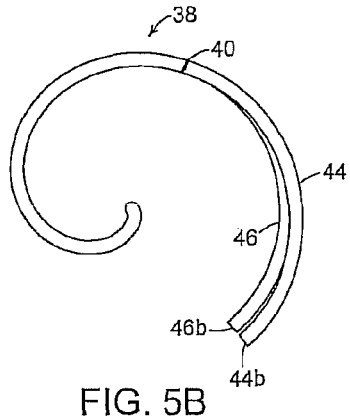

In accordance with another aspect of the present invention, as shown in FIGS. 5A and 5B, a segmented laying pipe 38 is subdivided at 40 into an entry section 42 and differently configured and alternatively employable delivery sections 44, 46. The entry section 42 has an entry end 42*a* leading to an intermediate end 42*b*, with the entry end aligned on the axis X to receive hot rolled product from the rolling mill. Each of the delivery sections 44, 46 has an entry end 44*a*, 46*a* adapted to be positioned to receive the product from the intermediate end 42*b* of the entry section, and respective delivery ends 44*b*, 46*b* spaced from the axis X by different radii. The product exits from the delivery ends 44*b*, 46*b* as the helical series of rings 18. With this arrangement, only the delivery sections 44, 46 and respective support components are interchanged alternatively to accommodate either the smaller or larger ranges of product sizes.

Figure 6:
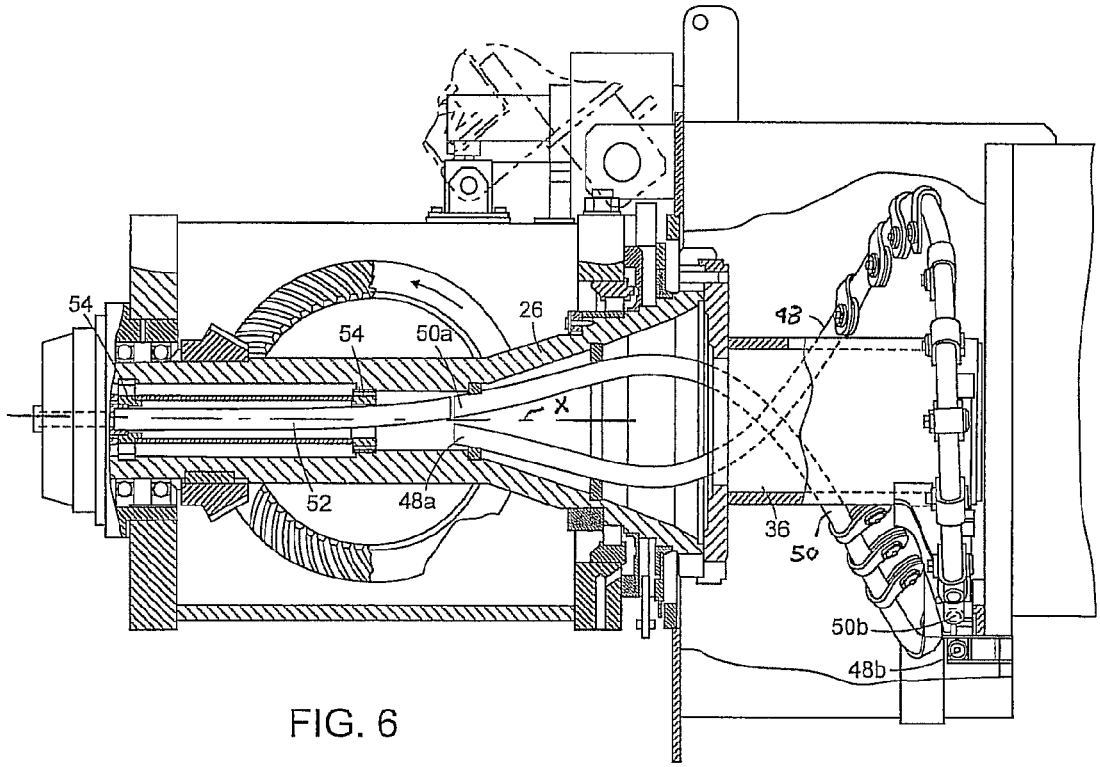
FIG. 6 is a view of parts of a laying head including dual differently configured delivery sections of laying pipes which are alternatively connected to a common rotatable entry section.

In FIG. 6, two differently configured laying pipe delivery sections 48, 50 are fixed with respect to each other and carried by the quill 26 and support 36. The entry ends 48*a*, 50*a* of the delivery sections 48, 50 are located 180° apart and spaced from axis X. The exit ends 48*b*, 50*b* are spaced by different radii from axis X. A common entry section 52 is rotatably supported within the quill 26 on bearings 54. In the position shown, entry section 52 is adjusted to direct products into the entry end 50*a* of pipe delivery section 50. By rotatably adjusting entry section through 180°, products will be alternatively directed into the entry section 48*a* of pipe delivery section 48.

Figure 7:
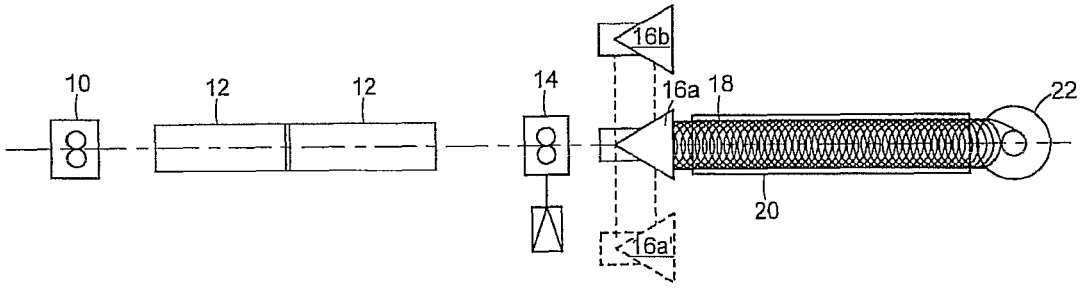
FIG. 7 is a view similar to FIG. 1 showing interchangeable laying heads, with one having a laying pipe configured to form rings of a diameter different from the diameter of the rings formed by the laying pipe of the other laying head.

In accordance with still another aspect of the present invention, as shown in FIG. 7, two laying heads 16*a*, 16*b* are interchangeably arranged along the processing line. Laying head 16*a* is equipped with the laying pipe 34 of FIGS. 4A and 4B, and laying head 16*b* is similarly equipped with laying pipe 34'. When laying head 16*a* is shifted to the position shown in broken lines at 16*a'*, the other laying head 16*b* can be placed on the processing line. The laying heads are thus interchangeable to accommodate different ranges of product sizes.

It should be evident that this disclosure is by way of example, and that various changes may be made by adding, modifying or eliminating details without departing from the fair scope of the teaching contained in this disclosure. The invention therefore is not limited to particular details of this disclosure except to the extent that the following claims are necessarily so limited.

We claim:

1. A method of processing different sized long products delivered from a rolling mill, said method comprising:

forming products within a first range of sizes into helical formations of rings having a first diameter, and alternatively forming products within a second range of sizes larger than the largest product size within said first range into helical formations of rings having a second diameter larger than said first diameter, wherein said products are formed into said helical formations of rings by passing said products through the rotating curved laying pipe of a laying head, and wherein said first and second ring diameters are achieved by alternatively employing differently configured interchangeable first and second laying pipes;

depositing said helical formations of rings onto a conveyor for transport to a reforming station; and gathering said helical formations of rings into coils at said reforming station.

2. A method of processing different sized long products delivered from a rolling mill, said method comprising:

forming products within a first range of sizes into helical formations of rings having a first diameter, and alternatively forming products within a second range of sizes larger than the largest product size within said first range into helical formations of rings having a second diameter larger than said first diameter, said first and second ring diameters being achieved by passing said products through the rotating curved laying pipe of a laying head, said laying pipe being segmented with a single entry section and differently configured and alternatively employable first and second delivery sections;

depositing said helical formations of rings onto a conveyor for transport to a reforming station; and gathering said helical formations of rings into coils at said reforming station.

3. The method of claim 2 wherein said first and second delivery sections are fixed with respect to each other, and wherein said entry section is rotatably adjusted to alternatively communicate with one or the other of said delivery sections.

4. A system for processing different sized long products delivered from a rolling mill, said system comprising:

a laying head having a first rotating curved laying pipe for forming products within a first range of sizes into helical formations of rings having a first diameter, and having a second rotating curved laying pipe for forming products within a second range of sizes larger than the largest product size within said first range into helical formations of rings having a second diameter larger than said first diameter, said first and second laying pipes having different first and second configurations that may be alternatively employed to achieve said first and second ring diameters;

a conveyor for receiving said helical formation of rings from said laying head and for transporting said helical formation of rings away from said laying head; and a reforming chamber for receiving said helical formation of rings from said conveyor and for gathering said helical formations of ring into coils.

5. A system for processing different sized long products delivered from a rolling mill, said system comprising:

a laying head having a rotating curved laying pipe for forming products within a first range of sizes into helical formations of rings having a first diameter, and for alternatively forming products within a second range of sizes larger than the largest product size within said first range into helical formations of rings having a second diameter larger than said first diameter, said laying pipe having a single entry section and differently configured first and second delivery sections that may be alternatively employed to achieve said first and second ring diameters;

a conveyor for receiving said helical formation of rings from said laying head and for transporting said helical formation of rings away from said laying head; and a reforming chamber for receiving said helical formation of rings from said conveyor and for gathering said helical formations of rings into coils.

6. The system of claim 5 wherein said first and second delivery sections are fixed with respect to each other, and wherein said entry section is rotatably adjustable to alternatively communicate with one or the other of said delivery sections.

* * * * *